US009697978B2

(12) United States Patent
Jensen

(10) Patent No.: US 9,697,978 B2
(45) Date of Patent: Jul. 4, 2017

(54) MULTI-FREQUENCY KLYSTRON DESIGNED FOR HIGH EFFICIENCY

(71) Applicant: The Board of Trustees of the Leland Stanford Junior University, Palo Alto, CA (US)

(72) Inventor: Aaron Jensen, Boulder Creek, CA (US)

(73) Assignee: The Board of Trustees of the Leland Stanford Junior University, Palo Alto, CA (US)

( * ) Notice: Subject to any disclaimer, the term of this patent is extended or adjusted under 35 U.S.C. 154(b) by 0 days.

(21) Appl. No.: 15/181,239

(22) Filed: Jun. 13, 2016

(65) Prior Publication Data

US 2016/0372296 A1 Dec. 22, 2016

Related U.S. Application Data

(60) Provisional application No. 62/181,017, filed on Jun. 17, 2015.

(51) Int. Cl.
*H01J 25/10* (2006.01)
*H01J 23/38* (2006.01)
*H01J 23/207* (2006.01)

(52) U.S. Cl.
CPC ..... *H01J 25/10* (2013.01); *H01J 23/207* (2013.01); *H01J 23/38* (2013.01)

(58) Field of Classification Search
CPC .. H01J 23/38; H01J 23/40; H01J 25/10; H01J 25/34; H01J 25/78
USPC ..... 315/5.39, 5.41, 39
See application file for complete search history.

(56) References Cited

U.S. PATENT DOCUMENTS

| | | | | |
|---|---|---|---|---|
| 3,811,065 | A | 5/1974 | Lien | |
| 4,764,710 | A * | 8/1988 | Friedlander | H01J 25/10 315/5.39 |
| 5,469,024 | A * | 11/1995 | Kirshner | H01J 23/005 315/39 |
| 6,465,958 | B1 | 10/2002 | Wilcox | |
| 6,856,105 | B2 | 2/2005 | Yao | |
| 7,385,354 | B2 * | 6/2008 | Miyake | H01J 23/087 250/396 R |
| 8,975,816 | B2 | 3/2015 | Scheitrum | |
| 2008/0042073 | A1 * | 2/2008 | Kirshner | H01J 25/78 250/396 R |

(Continued)

OTHER PUBLICATIONS

Syratchev, I., "Prospects for High Efficiency Klystrons," EnEfficient RF Sources Workshop, Jun. 2014.

(Continued)

*Primary Examiner* — Tung X Le
(74) *Attorney, Agent, or Firm* — Lumen Patent Firm

(57) ABSTRACT

A multi-frequency klystron has an electron gun which generates a beam, a circuit of bunch-align-collect (BAC) tuned cavities that bunch the beam and amplify an RF signal, a collector where the beam is collected and dumped, and a standard output cavity and waveguide coupled to a window to output RF power at a fundamental mode to an external load. In addition, the klystron has additional bunch-align-collect (BAC) cavities tuned to a higher harmonic frequency, and a harmonic output cavity and waveguide coupled via a window to an additional external load.

2 Claims, 3 Drawing Sheets

(56) References Cited

U.S. PATENT DOCUMENTS

| | | | | |
|---|---|---|---|---|
| 2013/0015763 | A1* | 1/2013 | Scheitrum | H01J 25/10 315/5.41 |
| 2013/0229109 | A1* | 9/2013 | Teryaev | H01J 25/10 315/5.39 |

OTHER PUBLICATIONS

Baikov, A. Y., O. A. Grushina, and M. N. Srikhanov, "Simulation of Conditions for the Maximal Efficiency of Decimeter-Wave Klystrons," Zhurnal Tekhnicheskoi Fiziki, vol. 84, No. 3, pp. 113-119, 2014.

* cited by examiner

MULTI-FREQUENCY KLYSTRON DESIGNED FOR HIGH EFFICIENCY

CROSS-REFERENCE TO RELATED APPLICATIONS

This application claims priority from U.S. Provisional Patent Application 62/181,017 filed Jun. 17, 2015, which is incorporated herein by reference.

STATEMENT OF GOVERNMENT SPONSORED SUPPORT

This invention was made with Government support under contract DE-AC02-76SF00515 awarded by the Department of Energy. The Government has certain rights in the invention.

FIELD OF THE INVENTION

The present invention relates generally to RF amplifier devices. More specifically, it relates to klystrons.

BACKGROUND OF THE INVENTION

Klystrons are high power microwave amplifiers invented at Stanford University in the 1930s and used extensively in transmitters for Radar, UHF television, satellite communications, and as power sources for electron accelerators used in medicine and high energy physics. In a conventional klystron, a cylindrical electron beam, confined by an electromagnet, interacts with a number of resonant cavities, amplifying an input signal by 30-60 dB.

FIG. 1 is a schematic view of a conventional klystron. An electron gun 100 emits a beam of electrons that is accelerated by a gain cavity 102 and travels through a drift space 104 and an output cavity 106 before terminating in a collector 108. An output waveguide 110 is coupled to the output cavity 106. RF power from the electron beam propagates through the output waveguide 110 through an RF window 112 and to an RF load 114. In conventional klystron, the RF power has a fundamental frequency determined by design, and it is desired that this RF power at the fundamental frequency is maximized. For example, the klystron shown in FIG. 1 is the 5045 klystron used in the SLAC linac. It has a fundamental frequency of 2.856 GHz with a peak power of 65 MW and average power of 45 kW.

SUMMARY OF THE INVENTION

The inventor has discovered that using a load to extract power from a 2nd harmonic cavity of a klystron as well as from the output fundamental mode cavity has the surprising result that not only is the efficiency of the fundamental mode increased but also significant power is generated at the 2nd harmonic, much more than would be expected. Consequently, a multi-frequency klystron design is provided. In its most general form, such multi-frequency klystrons extract higher harmonic power from the beam to provide substantial usable power at higher harmonics while also improving fundamental frequency output power. Various methods of extracting higher harmonic power out of the beam are applicable.

The inclusion of unloaded higher harmonic resonant cavities is a conventional method for increasing klystron efficiency at the fundamental mode. However, although it is known to use an unloaded harmonic cavity in a klystron, no loaded harmonic cavities have been used. Because loading a harmonic cavity would be expected to reduce fundamental output power, conventional wisdom in the art is that a harmonic cavity should be a floating resonator, i.e., a resonator which is not coupled to a load. In contrast, the present invention explicitly teaches extracting power from a harmonic cavity as well as from the output fundamental mode cavity. This has the surprising result that not only is the efficiency of the fundamental mode increased but also significant power is generated at the harmonic, much more than would be expected.

In one aspect, the present invention provides a multi-frequency klystron that has an electron gun which generates a beam, a circuit of bunch-align-collect (BAC) tuned cavities that bunch the beam and amplify an RF signal, a collector where the beam is collected and dumped, a standard output cavity and waveguide coupled to a window to output RF power at a fundamental mode to an external load, additional bunch-align-collect (BAC) cavities tuned to a higher harmonic frequency, and a harmonic output cavity and waveguide coupled to a window to output RF power at a harmonic mode to an additional external load.

A multi-frequency klystron according to the invention is a microwave amplifier generating power at the fundamental frequency and also at higher harmonic(s). Such a multi-frequency klystron enables a variety of scientific, commercial, and military applications. These applications have previously not gained significant attention due to the lack of a compact, high power, low-weight multi-frequency microwave amplifier. For example, multi-frequency klystrons are an enabling technology for (1) dual frequency RF photocathode guns that can generate low RF emittance and linear longitudinal phase space distribution for particle accelerators and (2) multi-frequency accelerator structures capable of high gradient particle acceleration. Having a klystron that generates two or more frequencies could be a breakthrough for high gradient devices.

DETAILED DESCRIPTION

Figure 1:
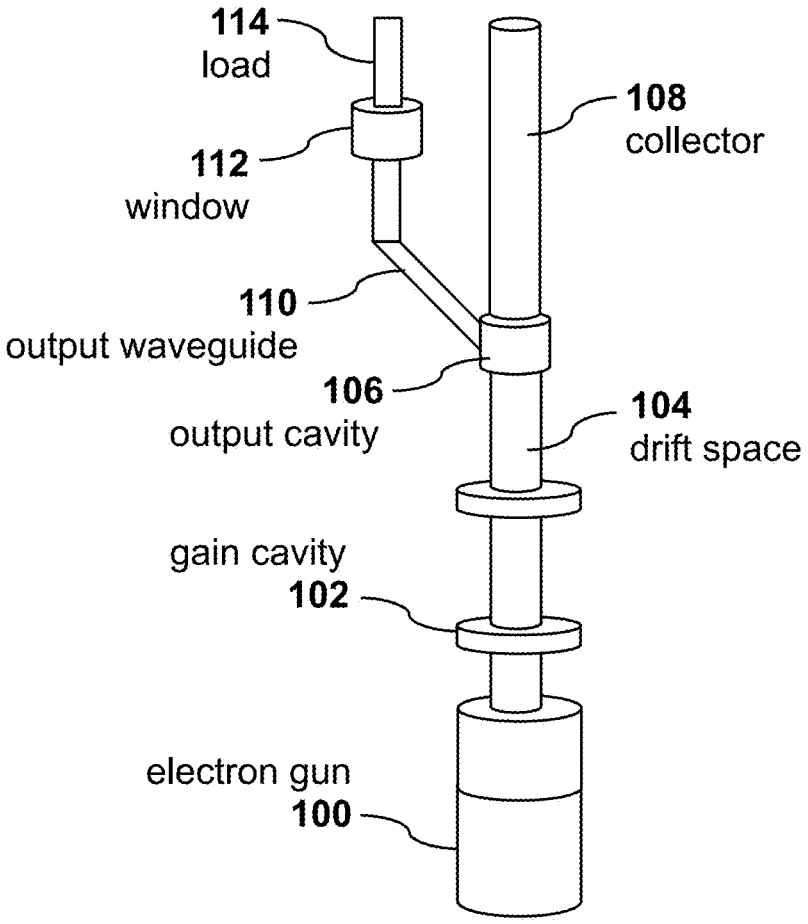
Fig. 1 (Prior Art)
FIG. 1 is a perspective schematic view of a conventional klystron.
Figure 2:
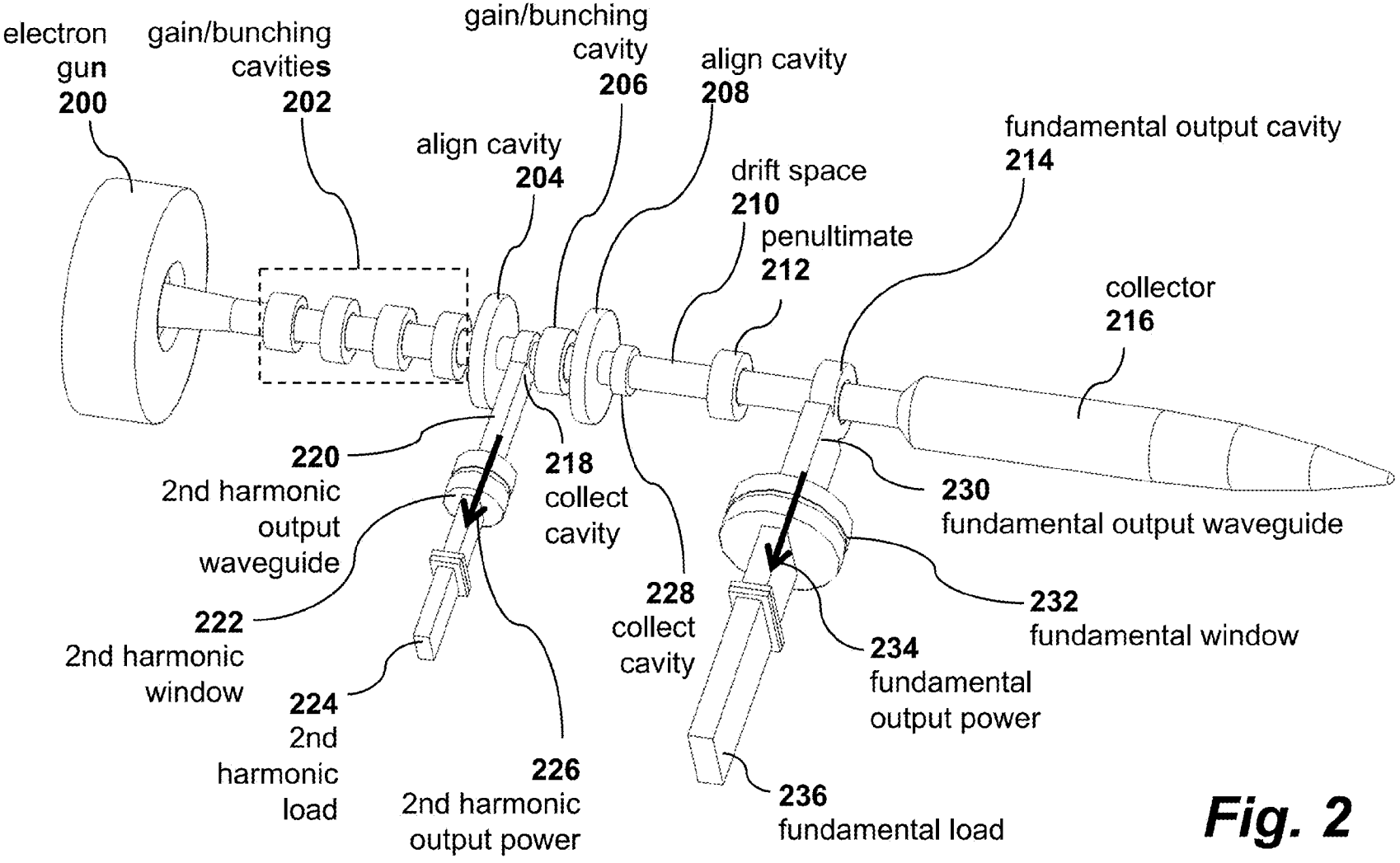
FIG. 2 is a perspective schematic view of a two-frequency klystron according to an embodiment of the present invention.

FIG. 2 is a perspective schematic diagram showing a vacuum model of a two-frequency klystron according to an embodiment of the invention. The model shows the full vacuum space of the two frequency klystron. The device includes components of a conventional klystron aligned along a beam axis starting with an electron gun 200 which generates the beam, followed by a circuit including gain/bunching cavities 202 that bunch the beam and amplify the RF signal, align cavity 204, a collect cavity 228, a drift space 210, a penultimate 212, funcamental output cavity 214, and ends with a collector 216 where the beam is collected/dumped. The circuit is also similar to conventional klystron in that it contains a series of standard cavities for delivering fundamental output power 234 to an off-axis load, including a collect/fundamental output cavity 214 on the beam axis, fundamental output waveguide 230, fundamental window 232, and fundamental load 236.

A change to the model for the two frequency klystron is the addition of several bunch-align-collect (BAC) cavities added to the drift space using the bunch-align-collect method, including gain/bunch cavity 206, align cavity 208, and collect cavity 218. The collect cavity is coupled to the main waveguide and tuned to a higher harmonic frequency per the BAC method. It couples RF power at the harmonic frequency to 2nd harmonic output waveguide 220. The RF power then propagates through 2nd harmonic window 222 to 2nd harmonic load 224, which may be any external load requiring higher harmonic power. These cavities allow the extraction of power from the higher harmonic cavity. It also improves electron bunching and increases efficiency of the klystron dramatically while also providing substantial power to the higher harmonic load.

The improved efficiency of multi-frequency klystrons according to the present invention is accomplished by externally loading the 2nd harmonic cavity. Such a 2nd harmonic cavity is normally used in the BAC method, but without loading.

Multi-frequency klystrons according to the present invention are preferably designed using the BAC tuning method, which is a standard technique described in the following article, which is incorporated herein by reference: Baikov, A. Y., O. A. Grushina, and M. N. Srikhanov, "Simulation of Conditions for the Maximal Efficiency of Decimeter-Wave Klystrons," Zhurnal Tekhnicheskoi Fiziki, vol. 84, no. 3, pp. 113-119, 2014.

The BAC method uses three cavities to bunch the electron beam: a bunching, an aligning, and a collecting cavity. In embodiments of the present invention, the collecting cavity is the 2nd harmonic output cavity and the aligning cavity is a cavity tuned low in frequency. In the BAC method, the 2nd harmonic cavity is not conventionally loaded. In klystrons according to embodiments of the present invention, in contrast, the 2nd harmonic cavity is loaded to produce 2nd harmonic power while at the same time improving output power at the fundamental frequency. The 2nd harmonic loading can be optimized to produce maximum 2nd harmonic power, fundamental power, or some combination of the two.

The bunch-align-collect method (BAC) involves use of a series of three cavities. There can also be multiple groups of three using the BAC method. This scheme uses one cavity tuned higher than the operating frequency to bunch the electrons (you might call this your typical klystron cavity), the next cavity is tuned below the operating frequency and aligns the velocities of the electrons in the center of the bunch to prevent them from overtaking each other and ultimately destroying the bunch (this happens while electrons outside the bunch continue to join the bunch), and the last cavity collects electrons outside the bunch into the bunch (second harmonic cavity). The second harmonic cavity is the cavity you couple to using a waveguide to produce second harmonic power.

The multi-frequency klystron is operated as a typical klystron, except that there is an additional waveguide 220 protruding from the klystron that delivers the 2nd harmonic power 226 which is delivered to a load 224. The load could be an external device or if 2nd harmonic power is not needed this could just be a conventional load that dissipates the power as heat.

A standard waveguide is attached to the second harmonic cavity using a coupling hole/opening to connect the waveguide and cavity. The size of the hole determines the amount of coupling/loading. This is common practice for coupling power. The same approach is used at the fundamental mode for the fundamental mode output cavity.

The 2nd harmonic is a standard harmonic at the frequency of the 2nd harmonic. The waveguide is coupled to the collect cavity 218 through a hole/opening. A window 222 is used to maintain the vacuum inside the klystron. This is the same approach conventionally used for the fundamental mode for the fundamental mode output cavity.

The size of the hole/opening between the waveguide and the cavity determines the loading. The loading may be increased to obtain a desired output. The design can be optimized to get maximum output at the fundamental, or it can be optimized to obtain maximum output at the second harmonic, or it can be optimized to produce a desired distribution of power between first and second harmonics. It is conventional practice in klystron design to guess and check (for the fundamental mode output cavity, for example) using a computer, and such techniques may be adapted for the multi-frequency klystrons based on the principles of the invention described herein.

These techniques can be used to design a multi-frequency klystron with more than two frequencies or a klystron where the second frequency is any higher harmonic of the fundamental mode. The BAC method is not limited to the addition of three cavities. Any number of cavities can be added to the klystron using the BAC principles, and the collecting cavity in each grouping of BAC cavities can be tuned to the harmonic of choice. In this way the output power at any harmonic of the fundamental mode can be added to the klystron by the addition of BAC cavities. This process can be repeated as desired to generate as many harmonics as needed within the same klystron.

Figure 3:
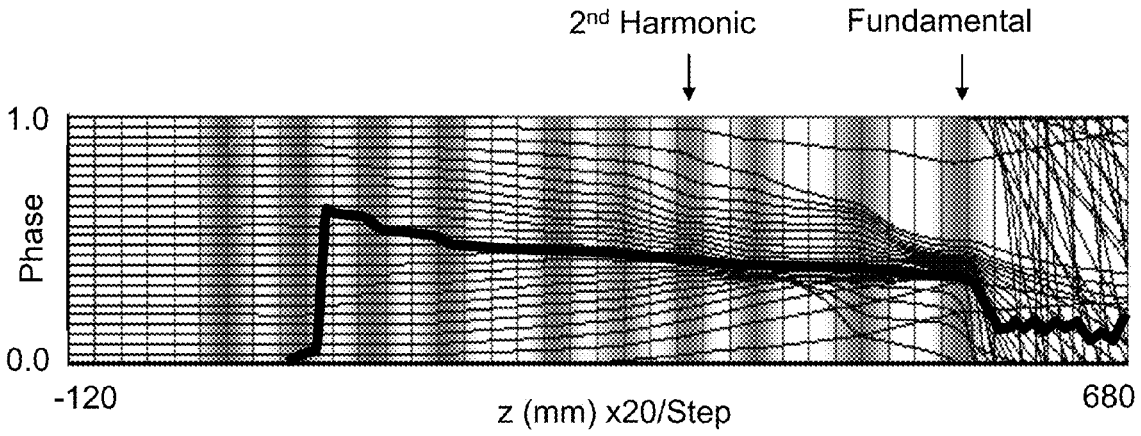
FIG. 3 is a graph of phase vs longitudinal position for a simulation of a two-frequency klystron according to an embodiment of the invention.

The multi-frequency klystron achieves efficiencies higher than conventional single frequency klystrons and simultaneously delivers substantial power at higher harmonic(s). Simulations have been completed showing overall efficiencies for an example tube with micropervience 2.0 in excess of 80% with about one third of the power being delivered to the second harmonic. For example, FIG. 3 is a graph of phase vs longitudinal position results from a simulation of a two-frequency klystron according to an embodiment of the invention.

The graph shows a simulation of a 2 μK klystron generating 80 MW of fundamental power at 2.856 GHz and 30 MW of second harmonic power at 5.712 GHz. Each vertical dark band represents a cavity, where in this simulation 10 cavities were used. The thin horizontal lines represent electron trajectories, and the thick horizontal line is the center of the bunch. The vertical axis is time/phase and represents one bunch. The horizontal axis represents distance. As the beam propagates from the gun (left) to the collector (right) it passes through the cavities and the trajectories (blue lines) bunch together (RF amplification). The power in the bunch is extracted by the output cavities, in this case tuned to the second harmonic and the fundamental frequencies.

The invention claimed is:

1. A multi-frequency klystron comprising:

an electron gun which generates a beam directed along a beam axis, a circuit of bunch-align-collect (BAC) tuned cavities that bunch the beam and amplify an RF signal, a collector where the beam is collected and dumped, a standard output cavity and waveguide coupled to a window to output RF power at a fundamental mode to an external load, additional bunch-align-collect (BAC) cavities tuned to a higher harmonic frequency, and a harmonic output waveguide coupled to the collect cavity of the additional BAC cavities and coupled to a window to output RF power at a harmonic mode to an additional external load, wherein the electron gun, the circuit of BAC tuned cavities, the standard output cavity, the additional BAC cavities, and the collector are all distinct components aligned along the beam axis.

2. The multi-frequency klystron of claim 1, wherein the additional bunch-align-collect (BAC) cavities are tuned to a second harmonic frequency.

* * * * *